United States Patent [19]

Gallagher et al.

[11] 3,939,676

[45] Feb. 24, 1976

[54] ADHESIVE GUARD HAIR REMOVAL

[75] Inventors: Nicholas D. Gallagher, Troy; Herbert N. Johnston, Columbus, both of Ohio; Robert J. Valihura, Lexington, Mass.; Henry E. Hull, Columbus, Ohio

[73] Assignee: The United States of America as represented by the Secretary of the Interior, Washington, D.C.

[22] Filed: Sept. 25, 1970

[21] Appl. No.: 75,398

Related U.S. Application Data

[62] Division of Ser. No. 687,510, Dec. 4, 1967.

[52] U.S. Cl. ..... 69/22; 156/68

[51] Int. Cl.[2] ..... C14B 15/00

[58] Field of Search ..... 8/160; 156/68; 69/22

[56] References Cited

UNITED STATES PATENTS

| | | | |
|---|---|---|---|
| 416,151 | 12/1889 | Gomess | 156/68 |
| 984,940 | 2/1911 | Landau | 156/68 |
| 2,693,610 | 11/1954 | Hensley | 15/104 |
| 2,708,761 | 5/1955 | Bergquist | 15/104 |
| 3,435,641 | 4/1969 | Pingree et al. | 69/22 |

FOREIGN PATENTS OR APPLICATIONS

| | | | |
|---|---|---|---|
| 3,647 | 8/1899 | United Kingdom | 156/68 |
| 6,454 | 4/1901 | United Kingdom | 156/68 |

*Primary Examiner*—Alfred R. Guest
*Attorney, Agent, or Firm*—Roland H. Shubert; Donald R. Fraser

[57] ABSTRACT

Long hairs of fur pelts known as guard hairs are removed to reveal soft underfur by contacting the pelt with a substrate coated with adhesive and then pulling the substrate away from the pelt. Recoverable or non-recoverable adhesive systems may be used.

10 Claims, 3 Drawing Figures

INVENTORS
NICHOLS D. GALLAGHER
HEBERT N. JOHNSTON
ROBERT J. VALIHURA
HENRY E. HULL

BY Ernest S. Cohen
Roland H. Shubert

ADHESIVE GUARD HAIR REMOVAL

This invention resulted from work done under Contract No. FCF-14-17-0007-322 with the Bureau of Commercial Fisheries of the Department of the Interior. In accordance with the requirements of the President's Patent Policy Statement of Oct. 10, 1963, 28 F.R. 10943, the domestic title to the invention is in the Government.

This is a division of application Ser. No. 687,510, filed Dec. 4, 1967. ,

BACKGROUND OF THE INVENTION

This invention relates to a selective removal of guard hairs from animal pelts. More particularly, it is related to a method of removing guard hairs by contact with adhesively coated substrates.

DESCRIPTION OF THE PRIOR ART

Guard hairs are presently removed from animal pelts by a technique known as unhairing. This technique involves the scraping of guard hairs from the pelt with a dull knife-like hand-held tool. This operation necessarily requires highly skilled and experienced labor. Numerous alternatives involve the use of machines designed to selectively pluck the longer, coarser guard hairs or, to clip them below the surface of the valuable underlayer of fine fur. It has been found, however, that such machines are not completely satisfactory in commercial operation, primarily because they are unable to effect substantial guard hair removal without damage to the underlying fur fibers.

SUMMARY OF INVENTION

Briefly, the present invention involves a process of selectively removing guard hairs from animal pelts containing both fine fur and coarse guard hairs by contacting the fur pelt with an adhesive coated substrate and then pulling it away. We have found that using this method of removal, guard hairs are extracted without damage to the underlying fur fibers.

Accordingly, it is the general object of this invention to provide an improved method of removing guard hairs from animal pelts containing the same. More specifically it is the object of this invention to provide a novel removal of guard hairs by contact with an adhesively coated substrate. Still further, it is an object of the invention to provide adhesive guard hair removal systems in which the adhesively coated substrate is recoverable.

These and other objects and features of the invention will become apparent upon consideration of the following detailed description of the invention.

DESCRIPTTION OF PREFERRED EMBODIMENTS

Figure 1:
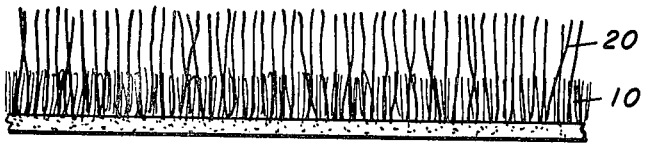
FIG. 1 is a cross-section of a pelt containing fur fiber and guard hairs.

Pelts in which a soft underfur is mixed with longer and stiffer hairs occur primarily in aquatic mammals including fur seal, beaver, otter, coney, muskrat and nutria. FIG. 1 is illustrative of the type of pelt referred to. In that figure, 10 refers to the underlying fur fiber and 20 to the guard hairs. The latter have also been termed water hairs, master hairs and coarse hairs, but will be referred to herein only as guard hairs.

Previous operations directed toward removal of guard hairs from pelts have been variously termed plucking, picking, clipping, shearing and unhairing. All have involved the use of machines designed to selectively extract the guard hairs or to cut them below the surface of the underlying fur. None have proven successful in avoiding injury to the underfur.

We have found that selective guard hair removal can be achieved by pressure contacting the pelt containing guard hairs with a substrate having an adhesive unhairing system. Using this technique only the guard hairs are removed.

The particular form of substrate used is not of critical importance. However, it is desirable to use substrates which have a flat generally smooth surface to hold an adhesive, and which are strong enough to resist tearing or shredding when they are pulled away from the pelt. Commercially available plastic or cloth tapes may serve as substrates as well as sheets, bands, screens or rollers of cloth, metal or plastic.

Adhesives used in the present invention are the type generally known as packaging adhesives, that is, ones that produce moderate to high strength in shear, tension and peel. It is desirable that the adhesive used have a high degree of tackiness characteristic of pressure-sensitive adhesives. Useful adhesives include not only water soluble forms but also hot-melt and solvent-dilutable compositions.

We have found that polyvinyl acetate emulsion adhesives are particularly suited for use in guard hair removal. Adhesives of this type are well known for their use in furniture assembly and fabrication as well as for general household use. An example of the general composition of this type of adhesive is given below in Table 1.

Table 1

| Ingredient | Part by Weight |
|---|---|
| Polyvinyl acetate emulsion | 145.5 |
| 50% dibutyl phthalate - 50% arochlor plasticizer | 4.5 |
| 10% aqueous solution of vinyl methyl ethermaleic anhydride copolymer | 125.0 |

The above composition is merely an example of a polyvinyl acetate emulsion. We have found that similar emulsions not containing plasticizers or additives may also be used. The combination of substrate and adhesive should be one in which the adhesive is adhered to the substrate more strongly than to the guard hairs. This will avoid separation of adhesive from the substrate upon stripping of the pelt.

Figure 2:
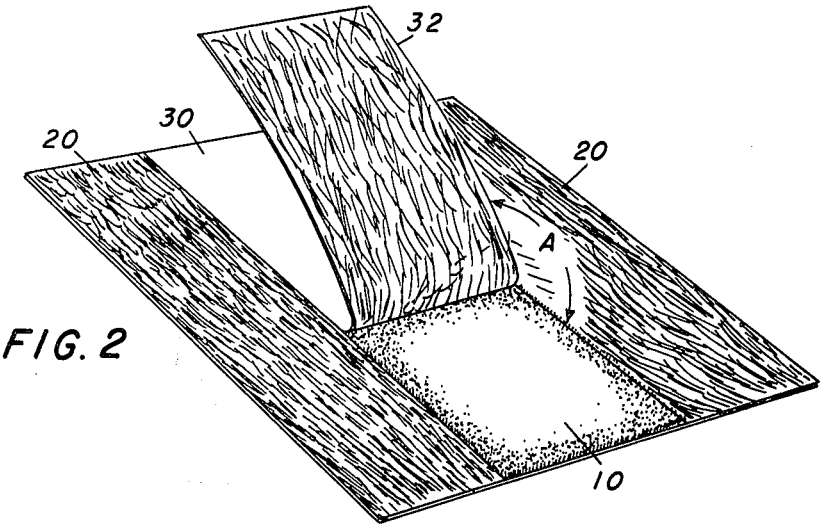
FIG. 2 is an illustration of adhesive removal of guard hairs with tape.

Guard hair removal is accomplished when a substrate coated with adhesive is pressed against the pelt and then pulled away. As shown in FIG. 2, the substrate may take the form of a tape. In that figure, a tape 30 is coated with adhesive on side 32. It is pressed against a pelt of the type shown in FIG. 1. Then, it is pulled away. This action, well known to doctors and patients who have removed adhesive bandages, creates a pull on guard hairs 20 causing their removal as they adhere to surface 32. The result is the exposure of the fine fur. For best results, the angle between the dehaired fur and the receding tape, shown as angle A in FIG. 2 should be greater than 90° and preferably in the range of from 135°–180°.

Figure 3:
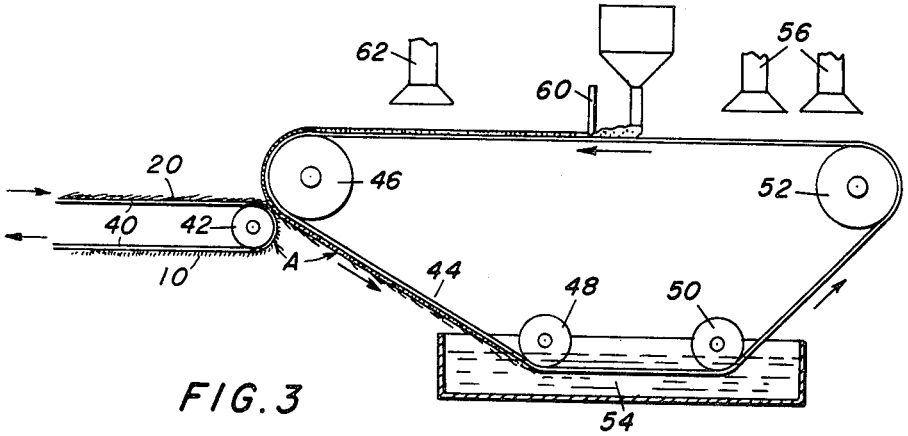
FIG. 3 is an illustration of a continuous process for guard hair removal wherein the adhesively coated substrate is cleaned and recoated with adhesive.

Although disposable tapes are useful in the practice of the invention, a recoverable substrate is preferred in large scale or commercial operations. Reusable flexible substrates such as metal cloth or plastic can be coated with a thin layer of adhesive, pressed against the pelt, pulled away from the pelt and then treated with a solvent to remove adhesive and hair, dried and then recoated with adhesive. Such a continuous system is shown in FIG. 3. There, 40 is a fur skin containing guard hairs 20 and underlying fur fiber 10. The skin is fed around a roller 42 where it is contacted under pressure with an adhesively coated flexiblle substrate 44. The substrate 44 forms an endless belt around rollers 46, 48, 50 and 52. As it travels around roller 46 it ispressed against skin 40. As it moves further, it is pulled away from the skin at an angle A of from 90 to 180° taking with it adhered guard hairs. The belt is then passed beneath roller 48 where it enters a bath 54 filled with a solvent for the adhesive. Here, both adhesive and guard hairs are removed from substrate 44. Upon passing roller 50 the endless belt leaves bath 54 and travels around roller 52 where it is dried by dryers 56. Next it passes under an adhesive trough 58 where new adhesive is deposited on the substrate. A doctor blade 60 spreads the adhesive to a desired height before substrate 44 again passes around roller 46. If necessary auxiliary dryer 62 may be placed after the doctor blade to assure that the adhesive is tacky prior to use.

The arrangement shown in FIG. 3 is merely one form of a continuous system. Other features may be incorporated into the system including, a means to remove hair from adhesive, means such as distillation or extraction to recover and recycle used adhesive and solvent and means to vary the pressure and time and angle of contact as well as the speed of the pelt 40 or substrate 44. Further, the recoverable substrate could take the form of a surface of a large drum rather than an endless belt, though the latter is preferred. The following example describes an embodiment of the invention as related to guard hair removal of fur seal skins.

EXAMPLE

An untreated fur seal pelt is pressed from 150–330 psi for a dwell time of 30 seconds against a tin panel coated 5-mil thick with polyvinyl acetate emulsion adhesive. The pelt is pulled away at a 10–12 inch per minute removal rate at an angle of 140°–180°. Under these conditions, substantial guard hair removal is effected without damage to the fine underfur.

Though the invention has been described with reference to preferred embodiments, it will be appreciated that various adaptations and modifications will be within the spirit and scope of the invention as distinctly defined in the claims hereinbelow. For example, though such variables as contact time, pressure of contact and stripping speed are all important, these factors may vary according to the particular pelt undergoing treatment and the adhesive used. It is within the routine skill of an operator to quickly and easily optimize these variables in specific fur treatments.

What is claimed is:

1. A method for selectively removing guard haid from animal pelts chosen from the group consisting of fur seal, beaver, otter, coney, muskrat and nutria which comprises:

pressing an adhesive coated substrate against the guard hair of said animal pelt, said adhesive comprising a polyvinyl acetate emulsion, and pulling the substrate away from the pelt thereby removing guard hair from the pelt without substantial removal of fur which underlies the guard hair.

2. The method of claim 1 wherein the animal pelt is fur seal.

3. The method of claim 2 wherein the pressing step is carried out at a pressure in the range of about 150 to about 330 psi.

4. The method of claim 3 wherein the angle between the substrate and the pelt is maintained at greater than 90° during the pulling step.

5. The method of claim 4 wherein the substrate is a flexible material of belt form.

6. The method of claim 5 wherein the adhesive coated substrate, after being pulled from the pelt and having guard hairs adhering thereto, is treated with a solvent to remove the adhesive and adhering guard hairs from the substrate.

7. The method of claim 6 wherein the cleaned substrate is recoated with adhesive and is again used to remove guard hair from a fur seal pelt.

8. The method of claim 7 wherein guard hair is separated from the adhesive and solvent and the adhesive is recovered for reuse,

9. The method of claim 5 wherein the substrate is pulled away from the pelt at a rate of about 10 to 12 inches per minute.

10. The method of claim 9 wherein the angle between the substrate and the pelt is maintained between 135° and 180° during the pulling step.

* * * * *